US007950469B2

(12) United States Patent
McGregor et al.

(10) Patent No.: US 7,950,469 B2
(45) **Date of Patent: *May 31, 2011**

(54) MODULAR WELL TOOL SYSTEM

(75) Inventors: Ronald W. McGregor, Carrollton, TX (US); David G. Dearing, Lewisville, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/725,190

(22) Filed: Mar. 16, 2010

(65) Prior Publication Data

US 2010/0170680 A1 Jul. 8, 2010

Related U.S. Application Data

(63) Continuation of application No. 11/228,932, filed on Sep. 16, 2005, now Pat. No. 7,694,745.

(51) Int. Cl.
*E21B 33/129* (2006.01)

(52) U.S. Cl. ..... 166/387; 166/240; 166/123

(58) Field of Classification Search ..... 166/387, 166/240, 118, 123, 125, 134
See application file for complete search history.

(56) References Cited

U.S. PATENT DOCUMENTS

| | | | | |
|---|---|---|---|---|
| 4,583,590 | A | 4/1986 | Greenlee et al. | |
| 4,750,564 | A | 6/1988 | Pettigrew et al. | |
| 4,838,348 | A | 6/1989 | Dearing | |
| 4,945,993 | A * | 8/1990 | Dickson et al. | 166/321 |
| 5,180,008 | A | 1/1993 | Aldridge et al. | |
| 6,516,882 | B2 | 2/2003 | McGregor et al. | |
| 6,619,388 | B2 | 9/2003 | Dietz et al. | |
| 6,691,788 | B1 | 2/2004 | Dearing | |
| 6,702,018 | B2 | 3/2004 | McGregor et al. | |
| 6,708,768 | B2 * | 3/2004 | Slup et al. | 166/382 |
| 6,715,545 | B2 | 4/2004 | McGregor et al. | |
| 6,755,257 | B2 * | 6/2004 | Spencer et al. | 166/383 |
| 6,789,624 | B2 | 9/2004 | McGregor et al. | |
| 6,799,633 | B2 | 10/2004 | McGregor | |
| 6,932,157 | B2 | 8/2005 | McGregor et al. | |
| 6,953,094 | B2 | 10/2005 | Ross et al. | |
| 7,694,745 | B2 * | 4/2010 | McGregor et al. | 166/387 |
| 2003/0188865 | A1 | 10/2003 | McGregor | |
| 2004/0112593 | A1 | 6/2004 | McGregor et al. | |
| 2004/0256161 | A1 * | 12/2004 | Aronstam et al. | 175/65 |
| 2005/0103494 | A1 | 5/2005 | McGregor et al. | |
| 2008/0311776 | A1 | 12/2008 | Cox et al. | |

OTHER PUBLICATIONS

Halliburton, "Basic Design and Maintenance Instructions", Halliburton Versa-Set™ Packer, copyright 2002, pp. 1-43

Advertisement, Halliburton, Versa-Set™ Retrievable Packer, copyright 2002, 2 pages.

Halliburton, "Versa-Set™ Well Completions," 2003 Presentation, 17 pages.

Communication from Canadian Intellectual Property Office in Canadian application No. 2,559,677, dated Aug. 7, 2009 (2 pages).

* cited by examiner

*Primary Examiner* — William P Neuder
(74) *Attorney, Agent, or Firm* — Joshua A. Griswold

(57) ABSTRACT

A well tool is adapted to couple to at least one of a wireline service tool and a tubing string and has an adapter component engaging portion adapted to couple to an adapter component. At least a first and a second interchangeable adapter components are operable to couple to the adapter component engaging portion. The first adapter component is adapted to perform a first function and the second adapter component is adapted to perform a second function.

21 Claims, 11 Drawing Sheets

MODULAR WELL TOOL SYSTEM

CROSS-REFERENCE TO RELATED APPLICATION

This application is a continuation application under 35 U.S.C. §120 of U.S. patent application Ser. No. 11/228,932, filed Sep. 16, 2005, now U.S. Pat. No. 7,694,745 entitled "Modular Well Tool System," the entire contents of which are incorporated by reference as if fully set forth herein.

BACKGROUND

The present disclosure relates in general to well tools, and more particularly, to well tools having modular components.

For each general type of well tool, for example, packers, bridge plugs, hangers, and others, there are a plurality of different operating conditions that various ones of the general type must satisfy. In the past, there have been full featured well tools that are configured to operate under all or substantially all of the different operating conditions. Full featured well tools are typically expensive and have features that may never be used. There have also been specialized tools that are configured to operate under specific operating conditions, but not all or substantially all of the operating conditions. The specialized tools, while sometimes less expensive, can be used only for the conditions to which they are specialized. Additionally, multiple specialized tools must be manufactured and, in some instances, inventoried to meet an array of operating conditions.

SUMMARY

The present disclosure relates in general to well tools, and more particularly, to well tools having modular components.

In one aspect, a well tool system includes a well tool adapted for insertion into a well and changeable between a set state and an unset state. The well tool has an adapter component engaging portion. A plurality of different, interchangeable adapter components are operable to couple to the adapter component engaging portion. A first adapter component is adapted to enable the well tool to be changed to a set state with a wireline service tool. A second adapter component is adapted to enable the well tool to be changed to a set state with a tubing string, and in some instances, unset and reset without removing the well tool from the well. A third adapter component is adapted to enable a portion of the well tool that engages the interior of the well to rotate about a longitudinal axis of the well tool relative to a portion of the well tool that does not engage the interior of the well. Others of the adapter components encompass one or more sensors that tell the state (set/unset/other) of the well tool, temperature sensors, pressure sensors, compositional sensors to measure the composition of the downhole fluids, provisions for fiber optic communications, provisions for laser induced breakdown spectroscopy, downhole computer processors, downhole electronic data storage, valves, a tubing conveyed perforating gun, sand filtration screens, and other features.

Another aspect encompasses a method whereby at least one of a first and a second interchangeable adapter components is coupled to an adapter engaging portion of a well tool. The first adapter component is operable to perform a first function in operation of the well tool and the second adapter component operable to perform a second function in operation of the well tool. The well tool is positioned in a well, and operated to perform at least one of the first and second functions.

Another aspect encompasses a method whereby at least one well tool is received. The well tool is actuable to engage a wall of a well bore and has a component engaging portion adapted to couple with a modular component. At least one modular component selected from a plurality of different modular components is received. The modular components are adapted to couple to the component engaging portion of the well tool and include a first modular component adapted to perform a first function in actuating the well tool to engage the wall of the well bore and a second modular component adapted to perform a second function in actuating the well tool in engaging the wall of the well bore. At least one well tool is grouped with at least one modular component for use at a well.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 4A depicts the illustrative resetable adapter component with extended drag blocks, and FIG. 4B depicts the illustrative resetable adapter component with retracted drag blocks.

FIG. 6A depicts the illustrative packer in a pre-set condition and configured to be changed to a set condition by a wireline actuation tool. FIG. 6B depicts the illustrative packer supending from a wireline in a set condition. FIG. 6C depicts the illustrative packer supending from a tubing in an unset condition.

FIG. 7A depicts the illustrative packer in a pre-set condition and configured to be changed to a set condition by a wireline actuation tool. FIG. 7B depicts the illustrative packer supending from a wireline in a set condition. FIG. 7C depicts the illustrative packer supending from a tubing in a pre-set/unset condition. FIG. 7D depicts the illustrative packer supending from a tubing in a set condition.

Like reference symbols in the various drawings indicate like elements.

DETAILED DESCRIPTION

Figure 1:
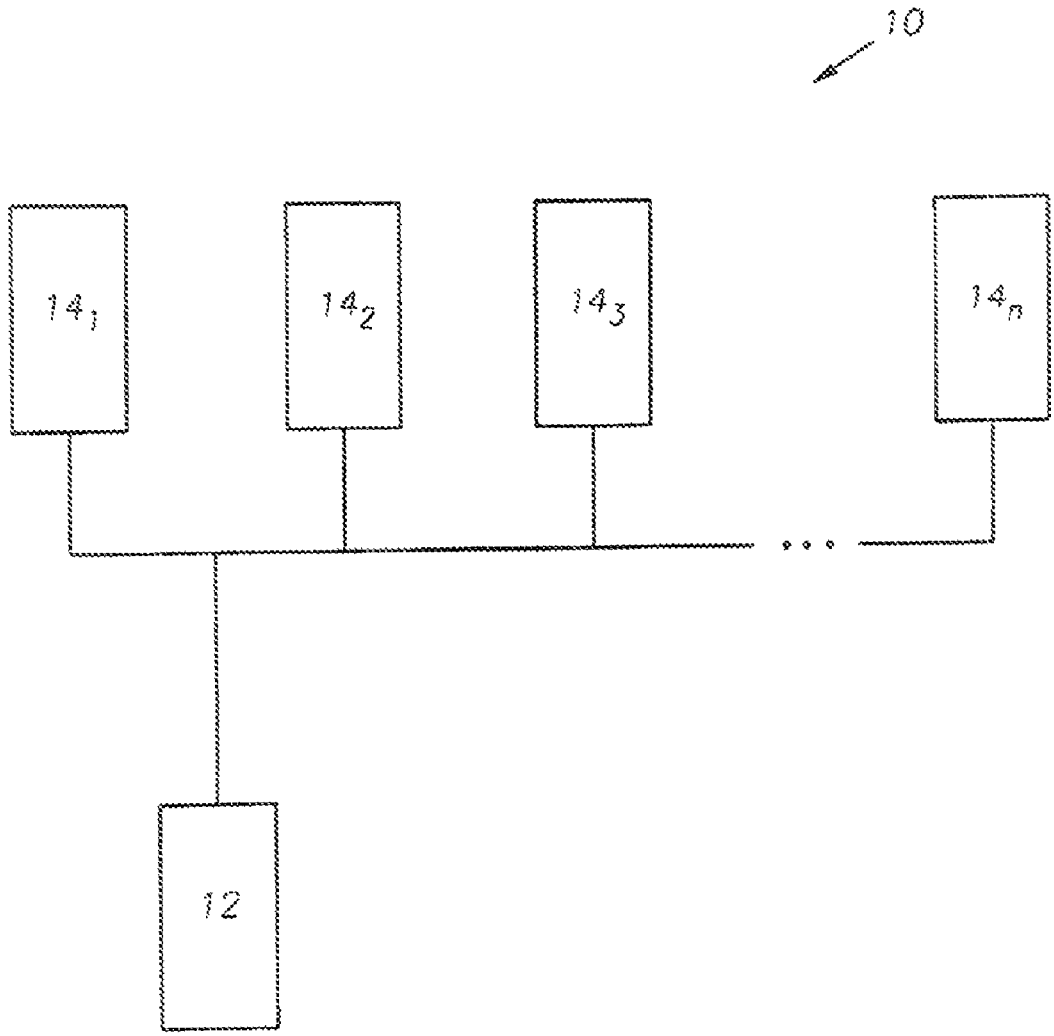
FIG. 1 is a schematic view of a modular well tool system in accordance with the invention.

Referring first to FIG. 1, a modular well tool system 10 in accordance with the invention includes a modular well tool 12 and one or more modular components $14_1 \ldots 14_n$ (collectively modular components 14). The modular well tool 12 is a down hole tool for performing one or more functions related to forming, completing, and/or re-working a well. The modular components 14 are each configured to cooperate with the modular well tool 12, and each interchange to provide different functionality to the modular well tool 12. The modular well tool 12 can be a number of different types of tools. Some examples include, a packer, a safety valve, a whipstock, a tubing hanger, and other tools. The modular components 14 may include one or more of sensors that tell the state (set/unset/other) of the modular well tool 12, temperature sensors, pressure sensors, compositional sensors to measure the composition of the downhole fluids, provisions for fiber optic communications, provisions for laser induced breakdown spectroscopy, downhole computer processors, downhole electronic data storage, mechanisms that enable the modular well tool 12 to be actuated by wireline, by tubing or by both, valves, a tubing conveyed perforating gun, sand filtration screens, and other features. Each modular component 14 may perform one or more functions in the operation of the modular well tool 12, and different modular components 14 may perform different functions. By way of example, the function of a packer is to seal an annular passage between the packer and an interior wall of the well bore. A modular component 14 that affects the manner in which the packer sets and unsets and a modular component 14 that includes pressure sensors to determine whether the seal is leaking are each performing a function in the operation of the packer and each performing a different function.

Figure 2:
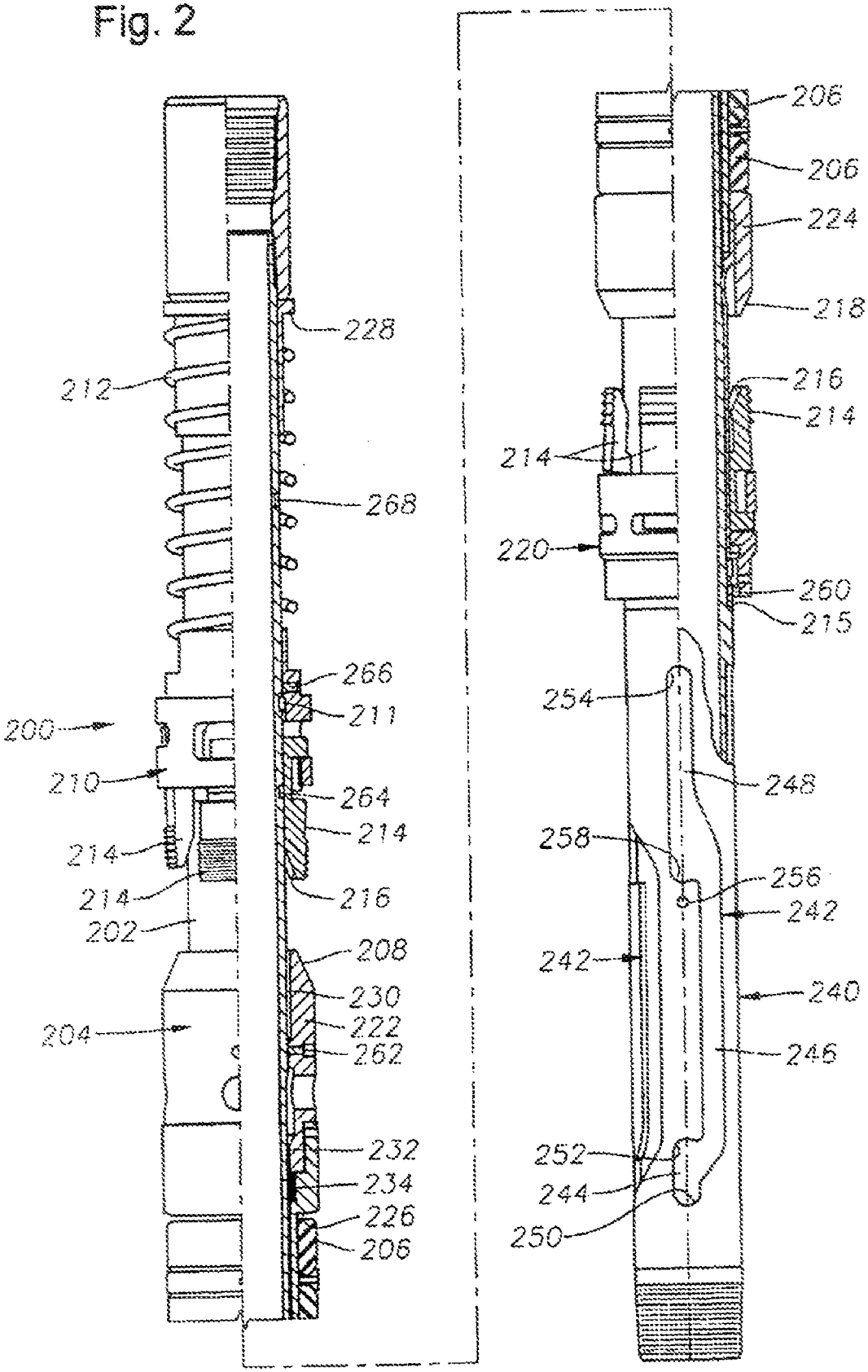
FIG. 2 is a partial cross-sectional view of an illustrative modular well tool, specifically a packer, constructed in accordance with the invention.

In one instance, the modular well tool 12 is a packer that is adapted to be run into a well and is actuable to seal against the interior thereof. Although there are numerous configurations of packers that can be used according to the concepts described herein, FIG. 2 depicts an illustrative packer 200. The illustrative packer 200 includes an elongate, tubular central body 202 that extends substantially the length of the packer 200 and is adapted to couple to other components, for example by threads, at its ends. A seal body 204 is slidingly received over the central body 202 such that the seal body 204 can move axially along the central body 202. The seal body 204 carries one or more packer seals 206 adapted to be extended axially outward into sealing engagement with an interior of the well (for example, well 604 shown in FIG. 6B). The illustrative seal body 204 of FIG. 2 is depicted with three packer seals 206.

For convenience of reference, the illustrative implementations described herein are described with respect to relative directions such as up, upward, upper, down, downward, and lower. It should be appreciated that these directions reference the orientation of the illustrative implementations as they would be oriented when installed in a substantially vertical well bore; however, it is within the scope of the invention to utilize the illustrative implementations in other orientations, such as in well bores that deviate from vertical (e.g. slanted or horizontal).

An upper end of the seal body 204 has a conical wedge surface 208 having its smallest diameter oriented up. An upper slip assembly 210 is slidingly received over the central body 202 between a shoulder 228 and the upper end of the seal body 204 such that the upper slip assembly 210 can move axially along the central body 202. The upper slip assembly 210 incorporates one or more slip members 214 having an internal conical wedge surface 216. The internal wedge surface 216 has its largest diameter oriented down (i.e. towards the central body 202). The internal wedge surface 216 is thus adapted to ride over the wedge surface 208 of the seal body 204 and drive the slip members 214 radially outward when the seal body 204 is moved axially into the upper slip assembly 210.

A lower portion of the seal body 204 has a conical wedge surface 218 having its smallest diameter oriented down. A lower slip assembly 220 is slidingly received over the central body 202 below the seal body 204. The lower slip assembly 220 incorporates one or more slip members 214 having an internal conical wedge surface 216. The internal wedge surface 216 has its largest diameter oriented up (i.e. toward the central body 202). The internal wedge surface is thus adapted to ride over the wedge surface 218 of the seal body 204 and drive the slip members 214 radially outward when the seal body 204 is moved axially into the lower slip assembly 220.

A spring member 212 may be provided between the upper slip assembly 210 and the shoulder 228 to bias the upper slip assembly 210 towards the seal body 204, and against a stop shoulder 211 that protrudes from the central body 202. Downward axial movement of the seal body 204 is limited by a second stop shoulder 215 that abuts the lower end of the seal body 204. The stop shoulder 211 and stop shoulder 215 are positioned such that when the upper slip assembly 210 abuts stop shoulder 211 and the seal body 204 abuts the stop shoulder 215, the upper slip assembly 210 is spaced apart from the seal body 204.

The seal body 204 has two portions, an upper seal body portion 222 and a lower seal body portion 224. The upper seal body portion 222 and lower seal body portion 224 are adapted to move axially towards one another when compressed between the upper slip assembly 210 and lower slip assembly 220. In the illustrative packer 200 of FIG. 2, the upper seal body portion 222 concentrically receives the lower seal body portion 224 thereon and the packer seals 206 are received over the upper seal body portion 222 to abut a shoulder 226 on the upper seal body portion 222. Therefore, when compressed between the upper slip assembly 210 and lower slip assembly 220, the lower seal body portion 224 bears against the packer seals 206 and axially compresses the packer seals 206 against the shoulder 226. Such axial compression of the packer seals 206 causes the seals 206 to deform radially outward. Although the illustrative packer 200 of FIG. 2 depicts the lower seal body portion 224 concentrically receiving the upper seal body portion 222 thereon, the upper seal body portion 222 could alternately receive the lower seal body portion 224 concentrically thereon. The packer seals 206 may alternately be provided on the lower seal body portion 224.

The central body 202 has a sealing surface 230 that resides above a non-sealing surface 232. The sealing surface 230 has a larger outer diameter than the non-sealing surface 232. The seal body 204 includes an internal seal 234 that is adapted to substantially seal against the larger outer diameter of the sealing surface 230 of the central body 202. The internal seal 234, however, does not seal against the smaller outer diameter of the non-sealing surface 232. Therefore, by manipulating the relative position of the seal body 204 to the central body 202, the internal seal 234 can be changed between substantially sealing with the central body 202 (i.e. on the sealing surface 230) and allowing passage of fluid between the seal body and central body 202. For example, in some instances, when the seal body 204 is pushed downward into the lower slip assembly 220, the internal seal 234 is positioned about the sealing surface 230 of the central body 202 and seals against passage of fluid between the seal body 204 and central body 202. In some instances, when the seal body 204 resides apart from the lower slip assembly 220, the internal seal 234 is positioned about the non-sealing surface 232 and allows passage of fluid between the seal body 204 and the central body 202.

Figure 5:
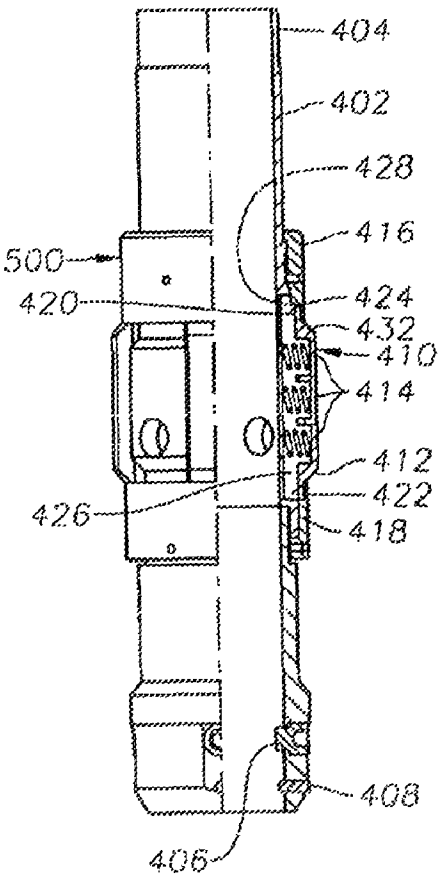
FIG. 5 is a partial cross-sectional view of another illustrative modular component, specifically a resetable adapter component without a clutch capability, constructed in accordance with the invention.
Figure 3:
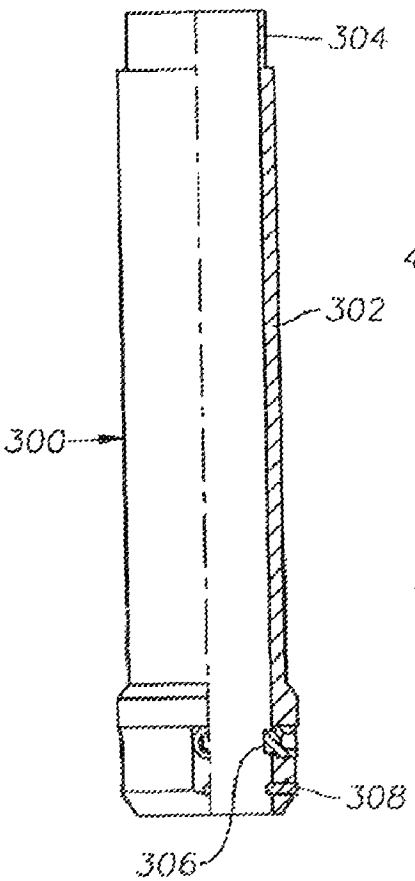
FIG. 3 is a partial cross-sectional view of an illustrative modular component, specifically a wireline adapter component, constructed in accordance with the invention.

The central body 202 includes a component engaging portion 240 adapted to receive one or more different modular components 14. Although there are numerous modular components that can be used according to the concepts described herein, three illustrative modular components 14 are depicted in the FIGS. 3-5. The details and operation of the modular components 14 are discussed in more detail below. However, of note, the modular components 14 interchange to provide different functionality to the illustrative packer 200 without modifying the illustrative packer 200 itself. The modular component 14 of FIG. 3, illustrative wireline adapter component 300, is configured to enable the illustrative packer 200 to be set on wireline (i.e. by a wireline service tool) and released by tubing. The remaining two modular components 14 of FIGS. 4 and 5, illustrative resetable adapter component 400 and illustrative clutchless resetable adapter component 500, enable the illustrative packer 200 to be set on wireline or set by tubing, released by tubing, and reset at the same or a different location in the well bore by tubing without withdrawing the illustrative packer 200 from the well bore. The illustrative packer 200, as well as its operation in setting and release, is the same with each modular component 14. In each instance, the modular component 14 is adapted to couple to the illustrative packer 200 (i.e. modular well tool) and remain coupled to the illustrative packer 200 throughout its operation. Although only three illustrative modular components 14 are discussed, it is within the scope of the invention to provide additional modular components with additional, fewer or different features.

In the illustrative packer 200 of FIG. 2, the component engaging portion 240 includes four J-slots 242, each residing at a quadrant of the central body 202. However, fewer or more J-slots 242, and J-slots 242 in different positions and of different configurations can be provided. Each J-slot 242 is defined by a lower axial portion 244, an intermediate axial portion 246, and an upper axial portion 248. The intermediate axial portion 246 is azimuthally offset from the lower and upper axial portions 244, 248. The lower axial portion 244 includes a lower receptacle 250 and an upper receptacle 252. The lower and upper receptacles 250, 252 are configured to receive and retain a J-slot pin (for example, J-slot pin 306 discussed below with respect to FIG. 3). The upper axial portion 248 includes an upper receptacle 254 that likewise is configured to receive and retain a J-slot pin, and includes a lower end 258.

Referring now to FIG. 3, one modular component 14 may be illustrative wireline adapter component 300. The illustrative wireline adapter component 300 includes a tubular body 302 sized to internally, concentrically receive the component engaging portion 240 of the illustrative packer 200. An upper end 304 of the tubular body 302 is adapted to couple to the lower slip assembly 220, for example by mating threads. The illustrative wireline adapter component 300 further includes one or more J-slot pins 306 that extend inwardly into the interior of the tubular body 302 and are adapted to be received in the J-slots 242 of the component engaging portion 240. The number of J-slot pins 306 may or may not correspond to the number of J-slots 242. Additionally, one or more shear screws 308 may be provided on the tubular body 302. The shear screws 308 are configured to be extended into engagement with the component engaging portion 240 (for example, at a corresponding detent (detent 256 in FIG. 2) in component engaging portion 240). When engaging the component engaging portion 240, the shear screws 308 retain the wireline adapter component 300 in fixed relation to the component engaging portion 240. The shear screws 308, however, are adapted to shear off when subjected to a predetermined shear force achieved by moving the wireline adapted component 300 in relation to the component engaging portion 240, and after shearing, the wireline adapter component 300 can move freely along the component engaging portion 240.

Figure 6A:
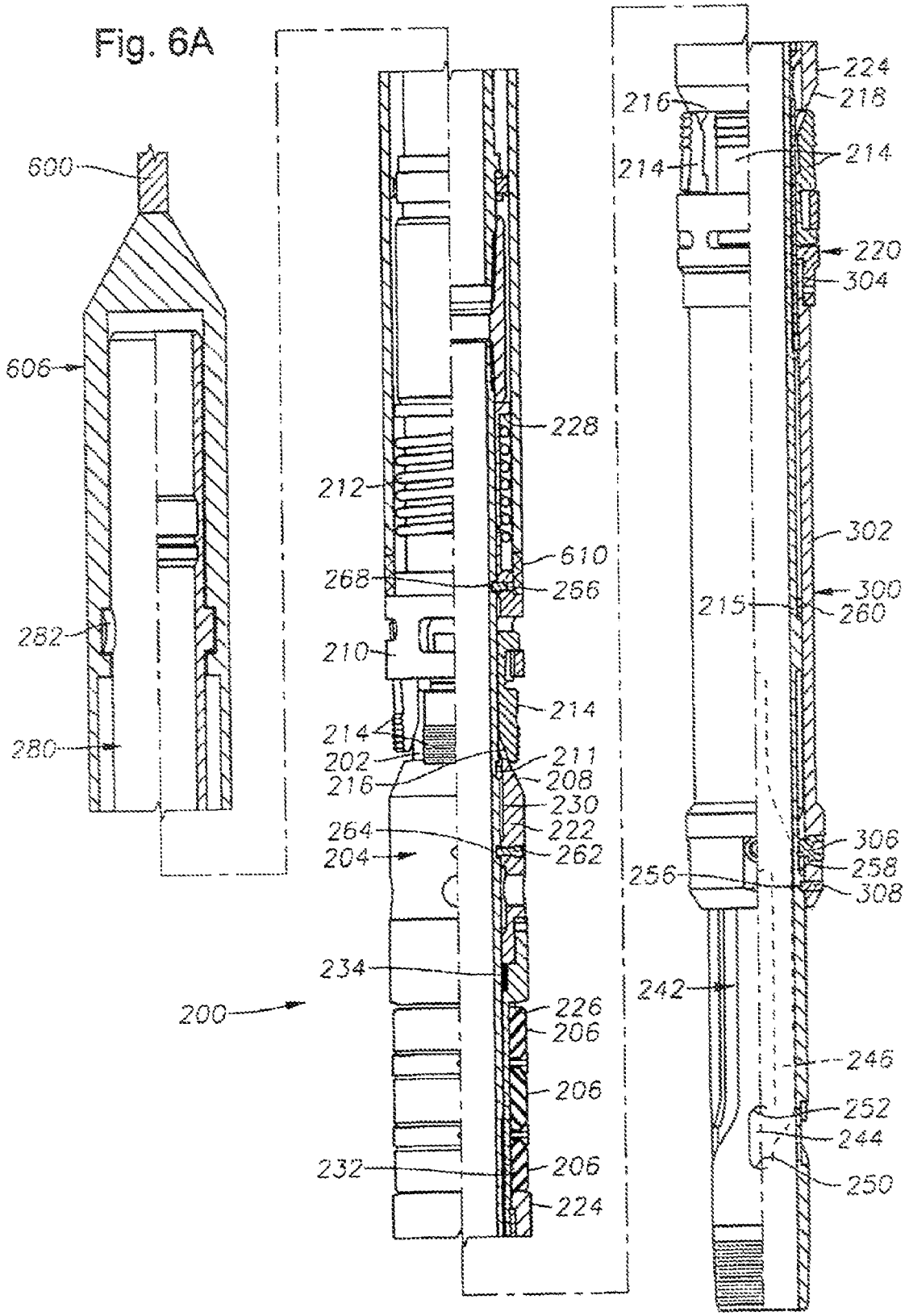
FIGS. 6A-6C are a partial cross-sectional views of the illustrative packer of FIG. 2 coupled with the illustrative wireline adapter component of FIG. 3.

Prior to use, the illustrative wireline adapter component 300 is concentrically received over the component engaging portion 240 of the illustrative packer 200 as shown in FIG. 6A. The upper end 304 of the tubular body 302 is coupled to the lower slip assembly 220. FIG. 6A depicts the illustrative packer 200 in a "pre-set" condition and configured to be changed to a "set" condition (FIG. 6B) by a wireline service or actuation tool. The set condition corresponds to the illustrative packer 200 actuated to grip and seal against a well bore wall. The wall of the well bore as used herein is meant to encompass a casing, liner, bare formation or other surface that forms the interior of the well. The pre-set condition corresponds to the illustrative packer 200 configured to pass through the well bore without gripping or sealing against the well bore wall, and thereafter be actuated to grip and seal against the well bore wall. In the pre-set condition, the J-slot pins 306 of the wireline adapter component 300 are received in the lower ends 258 of the upper portion 248 of the J-slots 242. The shear screws 308 are received in the detent 256. To receive the wireline adapter component 300 with the J-slot pins 306 in the upper portion 248, the central body 202 is shifted downward relative to the seal body 204. In this position, the internal seal 234 coincides with the sealing surface 230 of the central body 202 to substantially seal against passage of fluid between the central body 202 and the seal body 204. Additionally, the seal body 204 resides immediately adjacent the upper slip assembly 210 without actuating the slip members 214 thereof, and the lower slip assembly 220 resides immediately adjacent the seal body 204 without its slip members 214 being actuated. The seal body 204 can be held in position relative to the central body 202 with one or more shear screws 262 received in a corresponding detent 264 in the central body 202. Likewise the upper slip assembly 210 can be held in position relative to the central body 202 with one or more shear screws 266 received in a corresponding detent 268 in the central body 202.

Figure 6B:
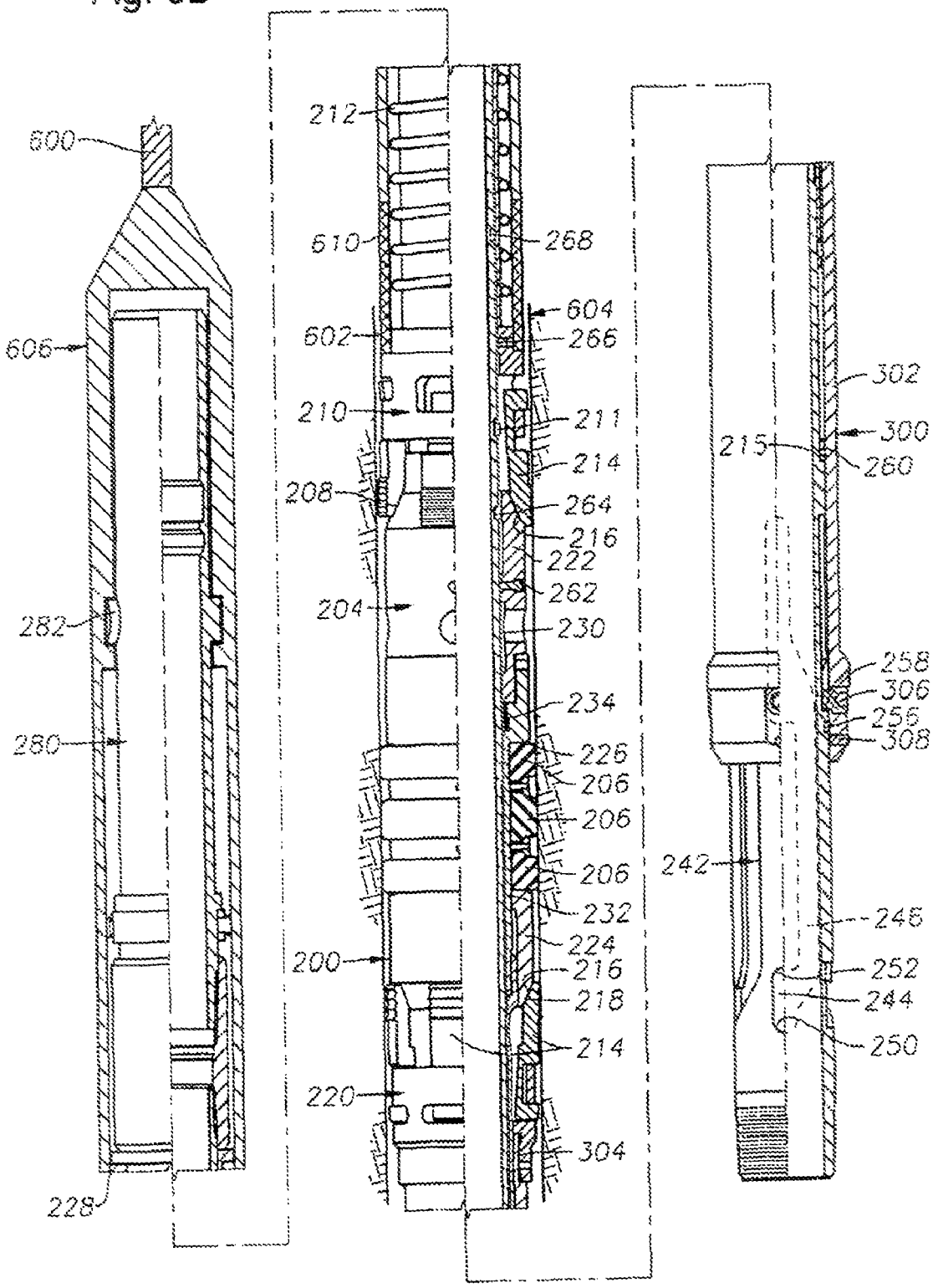

The upper end of the illustrative packer 200 is provided with an actuation tool engaging stub that is adapted to receive and interface with a wireline actuation tool. A wireline service or wireline actuation tool is a device adapted to engage the illustrative packer 200 and actuate the illustrative packer 200 to the set condition. Although numerous different wireline actuation tools can be used according to the concepts described herein, an illustrative wireline actuation tool 606 is depicted in FIGS. 6A and 6B. The illustrative packer 200 is provided with a tool engaging stub 280 configured to couple with the wireline actuation tool 606. The illustrative wireline actuation tool 606 is adapted to be received over the tool engaging stub 280 and engage outwardly extending lugs 282 on the stub 280. The illustrative wireline actuation tool 606 also has an end 610 that abuts the upper slip assembly 210. When actuated (electrically, by pyrotechnics, hydraulically, or otherwise), the illustrative wireline actuation tool 606 extends axially, thus extending the distance between its end 610 and the location at which it engages the lugs 282. The illustrative wireline actuation tool 606 is installed to the tool engaging stub 280 prior to running the illustrative packer 200 into the well bore.

FIG. 6B depicts the illustrative packer 200 supending from a wireline 600 and actuated in a set condition to grip and seal with an interior wall 602 of a subterranean well 604. As mentioned above, the wireline actuation tool 606 is actuable to axially extend the distance between its end 610 and the location at which it engages the lugs 282. When extended axially, the end 610 of the wireline actuation tool 606 bears against the upper slip assembly 210, moves the central body 202 axially upward in relation to the upper slip assembly 210, and shears shear screws 262 and 266. Because the illustrative wireline adapter component 300 is coupled to the central body 202 at the J-slots 242, it also moves upward and drives the lower slip assembly 220 upward into the seal body 204. The upper slip assembly 210, seal body 204, and lower slip assembly 220 are thus compressed between the end 610 of the wireline actuation tool 606 and the wireline adapter component 300. The slip members 214 of the upper slip assembly 210 and the lower slip assembly 220 ride up over the wedge surfaces 208, 218 of the seal body 204, and are forced outward to grip the interior wall 602 of the well 604. Additionally, the upper portion 222 and lower portion 224 of the seal body 204 are moved toward one another and deform the packer seals 206 to extend radially into sealing engagement with the interior wall 602 of the well 604. Thereafter, the illustrative packer 200 is in a set condition both gripping and substantially sealing with the interior wall 602 of the well 604.

In the set condition, the illustrative packer 200 is pressure energized. Pressure beneath the packer seals 206 drives the seal body 204 further into engagement with the upper slip assembly 210. Pressure above the packer seals 206 drives the seal body 204 further into engagement with the lower slip assembly 220. In both instances, driving the seal body 204 into further engagement with the upper or lower slip assembly 210, 220 increases the axial compressive force that the upper seal body portion 222 and the lower seal body portion 224 exert on the packer seals 206. The increased axial compression on the packer seals 206 increases the radial deformation, and thus the sealing force against the interior wall 602 of the well 604. Additionally, driving the seal body 204 into further engagement with the upper or lower slip assembly 210, 220 drives the respective slip member 214 into tighter gripping engagement with the interior wall 602 of the well 604.

Figure 6C:
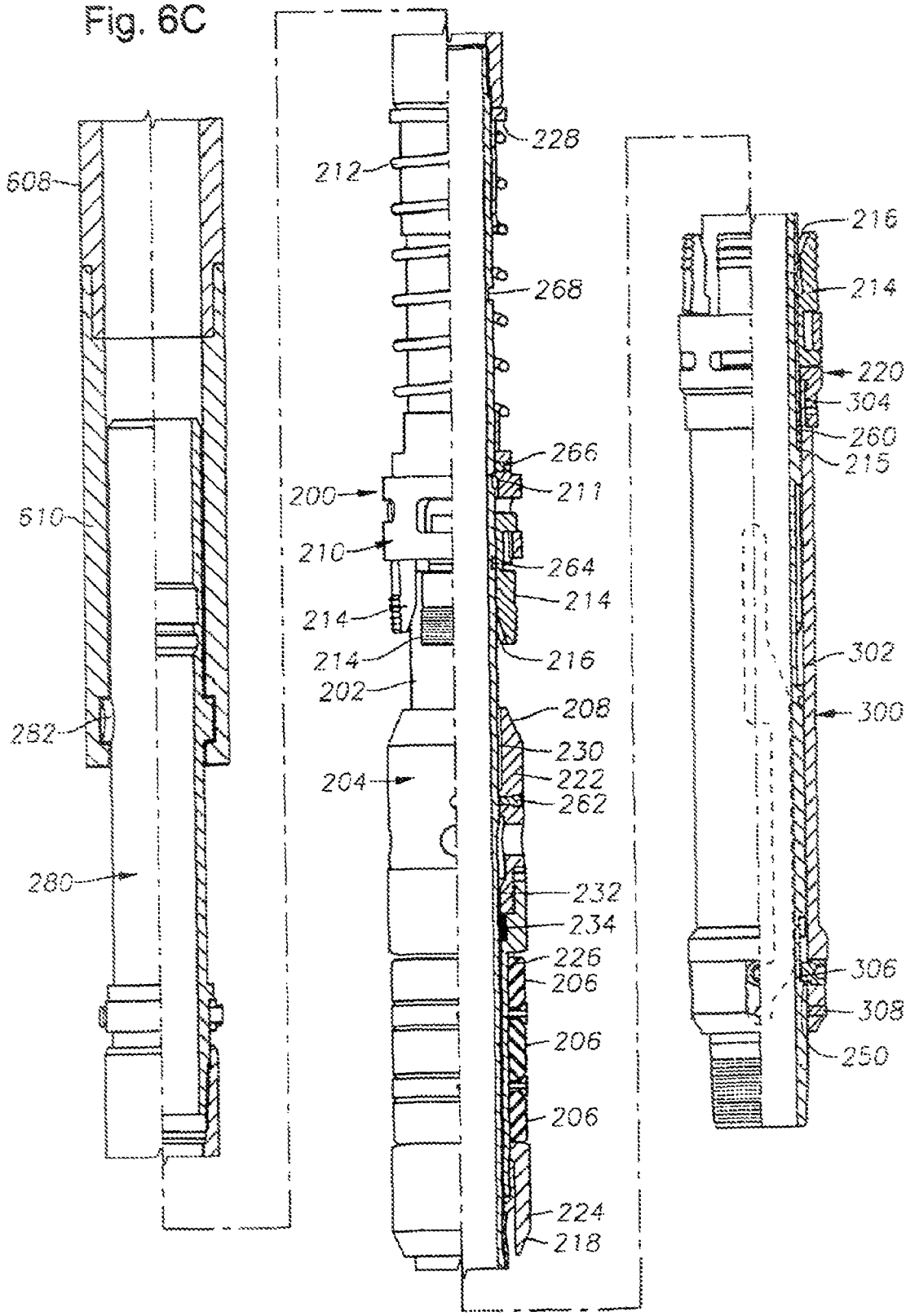

FIG. 6C depicts the illustrative packer 200 in an "unset" condition. The unset condition corresponds to the illustrative packer 200 released from gripping and sealing with the interior wall 602 of the well 604. The central body 202 is shifted upward so that the internal seal 234 resides over the non-sealing surface 232 of the central body 202 to allow passage of fluid between the central body 202 and the seal body 204.

The illustrative packer 200 is changed from the set condition to the unset condition by manipulating the central body. In the instant embodiment, the central body 202 is rotated clockwise and drawn upward. A downward force may also be applied through the central body 202 in some instances. Because most wireline actuation tools cannot rotate the central body 202 or apply substantially downward force to the central body 202, the wireline actuation tool 606 can be configured to release from the tool engaging stub 280 after being actuated and a tubing string 608 having an on/off adapter 610 can be attached in its place. An on/off adapter 610 is a coupling affixed to the end of the tubing string 608 that can be stabbed over and selectively attach/release the tool engaging stub 280. The illustrative on/off adapter 610 receives the lugs 282 of the tool engaging stub 280, for example, in J-slots (not specifically shown) provided in the interior of the illustrative on/off adapter 610. Of note, however, it is within the scope of the invention to use a wireline actuation tool that is capable of applying downward force to the central body 202 and rotating the central body 202 in lieu of a tubing string 608 and on/off adapter 610.

With the tubing string 608 attached to the tool engaging stub 280, the central body 202 may be manipulated with the tubing string 608. A downward force may first be applied through the central body 202 prior to rotating the central body 202 to lessen the engagement of the J-slot pins 306 in the lower ends 258 of the upper portion 248 of the J-slots 242. The downward force may be applied through the central body 202, for example, by allowing the weight of the tubing string 608 to rest on the central body 202. Thereafter, the central body 202 is rotated clockwise. Because the lower slip assembly 220 frictionally engages the interior wall 602 of the well 604, and the illustrative wireline component 300 is coupled to the lower slip assembly 220, the central body 202 rotates relative to the illustrative wireline component 300. The relative rotation moves the J-slot pins 306 of the wireline component 300 from the upper portion 248 of the J-slots 242, and orients the J-slot pins 306 with the intermediate portion 246 of the J-slots 242. Upon an upward pull on the central body 202, the J-slot pins 306 of the wireline component 300 traverse the intermediate portion 246 of the J-slots 242 and move to the lower portion 244 of the J-slots 242. As the J-slot pins 306 traverse the intermediate portion 246, the central body 202 is shifted upward relative to the seal body 204 and the internal seal 234 moves from sealing against the sealing surface 230 of the central body 202 to residing over the non-sealing surface 232. With the internal seal 234 residing over the non-sealing surface 232, fluid passes between the central body 202 and the seal body 204. The area between non-sealing surface 232 and seal 234 is relatively small; therefore, pressure gradually equalizes across the illustrative packer 200. As the pressure equalizes, the pressure energizing effect discussed above diminishes. Further upward pull withdraws the upper slip assembly 210 from engagement with the seal body 204, and releases the slip members 214 thereof from gripping engagement with the interior wall 602 of the well 604. Withdrawing the upper slip assembly 210 from engagement with the seal body 204 allows the lower seal body portion 224 and upper seal body portion 222 to extend axially and release the compressive force that deforms the packer seals 206 into sealing engagement with the interior well bore wall 602. The seal body 204 also withdraws from engagement with the lower slip assembly 220 and releases the slip members 214 thereof from gripping engagement with the interior wall 602 of the well 604. Thereafter, the illustrative packer 200 is in an unset condition.

Therefore, operation of the illustrative packer 200 using the illustrative wireline adapter component 300 is as follows. The illustrative wireline adapter component 300 is coupled to the component engaging portion 240 of the illustrative packer 200, the wireline actuation tool 606 is coupled to the actuation tool engaging stub 280, and the illustrative packer 200 configured in the preset condition. The wireline adapter component 300 is fixed to the component engaging portion 240 of the illustrative packer 200 with shear screws 308. The illustrative packer 200 is then lowered to a desired position in the well 604. Once in position, the wireline actuation tool 606 is actuated to change the illustrative packer 200 from the preset condition to the set condition. In the set condition, the illustrative packer 200 grips and seals against the interior wall 602 of the well 604. The wireline actuation tool 606 may be configured to release from the illustrative packer 200 after changing the illustrative packer 200 from the pre-set condition to the set condition.

When it is desired to change the illustrative packer 200 to an unset condition, a tubing string 608 having on/off adapter 610 is stabbed over the tool engaging stub 280 to engage the illustrative packer 200. A downward force may be applied to the illustrative packer 200 with the tubing string 608, and the tubing string 608 is rotated clockwise to rotate the central body 202. The rotation releases the J-slot pins 306 from the upper portion 248 of the J-slots 242, and orients the J-slot pins 306 with the intermediate portion 246 of the J-slots 242. An upward pull on the central body 202 with the tubing string 608 shifts the central body 202 relative to the seal body 204, so that the internal seal 234 moves from sealing against the sealing surface 230 to residing over the non-sealing surface 232. Fluid passes between the central body 202 and the seal body 204 and pressure gradually equalizes across the packer 200. Continuing the upward pull withdraws the upper and lower slip assemblies 210, 220 and the packer seals 206 from engagement with the interior well bore wall 602. Thereafter, the illustrative packer 200 can be withdrawn from the well 604.

Figure 4B:
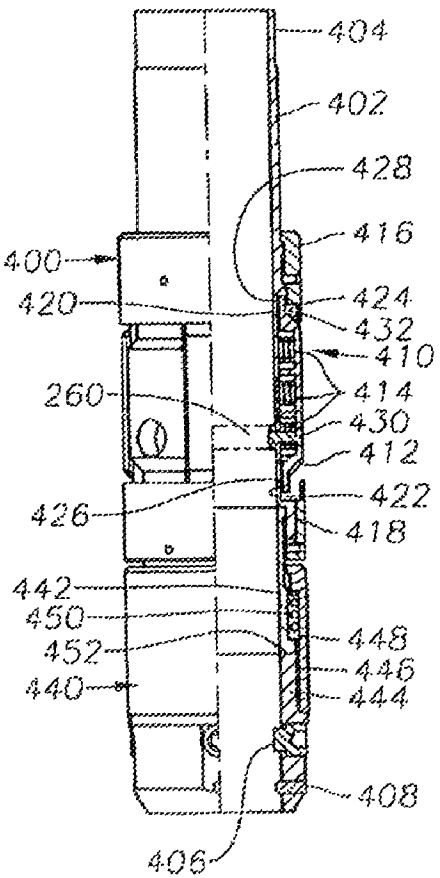
FIGS. 4A and 4B are partial cross-sectional views of another illustrative modular component, specifically a resetable adapter component having a clutch assembly, constructed in accordance with the invention.
Figure 4A:
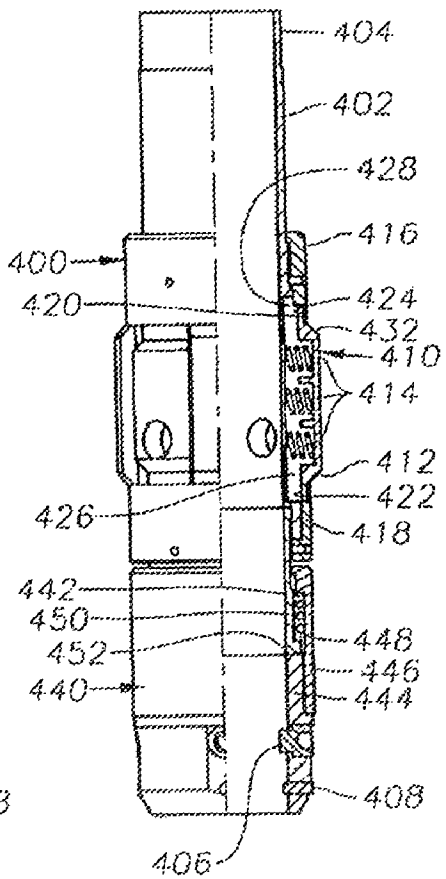

Referring to FIGS. 4A and 4B, another modular component 14 may be illustrative resetable adapter component 400. The illustrative resetable adapter component 400 enables the illustrative packer 200 to be set on wireline or set by tubing, released by tubing, and withdrawn from the well or reset at the same or a different location in the well bore by tubing without withdrawing the illustrative packer 200 from the well bore. As with the illustrative wireline adapter component 300 discussed above, the illustrative resetable adapter component 400 includes a tubular body 402 sized to internally, concentrically receive the component engaging portion 240 of the illustrative packer 200. The upper end 404 is adapted to couple to the lower slip assembly 220, for example by mating threads, and one or more inwardly extending J-slot pins 406 are adapted to be received in the J-slots 242 of the component engaging portion 240. One or more inwardly extending shear screws 408 are provided to engage the component engaging portion 240, for example, at a corresponding detent 256.

The illustrative resetable adapter component 400 is further provided with a drag block assembly 410. The drag block assembly 410 includes one or more radially extendable/retractable drag blocks 412 circumferentially spaced about its perimeter. The drag blocks 412 are biased radially outward by one or more springs 414 positioned between the drag blocks 412 and the tubular body 402 to contact and frictionally engage an interior of the well bore.

The drag blocks 412 are depicted in FIG. 4A in a radially extended position. The drag blocks 412 are radially retained in relation to the tubular body 402 by an upper retaining housing 416 and a lower retaining housing 418. The upper retaining housing 416 resides adjacent an upper end of the drag blocks 412 and captures an upper lip member 420 of each drag block 412 in an outer cavity 424 defined between the upper retaining housing 416 and the tubular body 402. Likewise, the lower retaining housing 418 resides adjacent a lower end of the drag blocks 412 and captures a lower lip member 422 of each drag block 412 in a cavity 426 between the lower retaining housing 418 and the tubular body 402. Referring briefly to FIG. 7C, the drag blocks 412 are configured to contact and frictionally engage the interior well bore wall 602 when in the radially extended position. Such frictional engagement substantially holds the illustrative resetable adapter component 400 in relation to the well 604, and, as is discussed in more detail below, allows the central body 202 to be manipulated in relation to the illustrative resetable adapter component 400 in setting and resetting the illustrative packer 200.

FIG. 4B depicts the drag blocks 412 in a radially retracted position. In the radially retracted position, the drag blocks 412 are configured so that they do not substantially hold the resetable adapter component 400 in relation to the well bore, and thus allow the resetable adapter component 400 to pass substantially freely through the well bore. The drag blocks 412 can be radially retained in the retracted position by the upper retaining housing 416. The upper retaining housing 416 defines an inner cavity 428 adjacent the outer cavity 424, but located radially inward and axially upward from the outer cavity 424. The drag blocks 412 are retained in the radially retracted position by compressing the drag blocks 412 radially inward, and shifting the drag blocks 412 axially upward so that the upper lip member 420 is received and captured in the inner cavity 428. A shear screw 430 is further provided in each of the drag blocks 412 to hold the drag blocks 412 in the radially retracted position. The shear screw 430 extends through each of the drag blocks 412 and into the interior of the tubular body 402 to couple, for example by mating threads, with a release ring 260 of the illustrative packer 200. The release ring 260 is positioned to bear against the central body 202, and move axially with the central body 202. Movement of the release ring 260 and the central body 202 without moving the resetable adapter component 400 shears the shear screws 430.

The outer edge of the drag blocks 412 has a chamfer 432 that abuts the upper retaining housing 416 when the upper lip member 420 is received in the inner cavity 428. The chamfer 432 slopes downward and outward from the upper end of the drag blocks 412, such that when the drag blocks 412 are moved radially outward, the chamfer 432 bears against the upper retaining housing 416 and shifts the drag blocks 412 axially downward. Therefore, to release the drag blocks 412 from being retained in the radially retracted position, the shear screw 430 is released, for example by being sheared at the release ring 260. The springs 414 bias the drag blocks 412 radially outward, and the chamfer 432 slides against the upper retaining housing 416 to shift the drag blocks 412 axially downward. Shifting the drag blocks 412 downward withdraws the upper lip member 420 out of the inner cavity 428 and enables the drag blocks 412 to move to the extended position. The shear screw 430 is sheared at the release ring 260 and released, thus releasing the drag blocks 412 from radially retracted position, by manipulation of the illustrative packer 200. In one instance, the shear screws 430 are sheared at the release ring 260 when the illustrative packer 200 is released from the gripping and sealing engagement with the interior of the well bore (i.e. released from the set condition to the pre-set/unset condition discussed below).

The illustrative resetable adapter component 400 of the FIGS. 4A and 4B is also provided with a clutch assembly 440. The clutch assembly 440 divides the illustrative resetable adapter component 400 into two portions, an upper portion 442 that includes the drag block assembly 410 and a lower portion 444 that includes the J-slot pins 406. The upper portion 442 and lower portion 444 can rotate relative to each other when a difference in torque applied between the upper portion 442 and the lower portion 444 exceeds a specified torque value. By allowing relative rotation of the upper portion 442 and the lower portion 444, the clutch assembly 440 reduces residual torque applied through the J-slot pins 406. In one instance, the clutch assembly 440 may prevent excess torque being applied to the J-slot pins 406 that may damage the J-slot pins 406. For example, if the illustrative packer 200 is rotated while being manipulated or run-into the well 604, and the drag block assembly 410 is engaging the interior wall of the well 602, the clutch assembly 440 would allow the upper portion 442 to rotate relative to the lower portion 444 if the resulting torque differential between the upper and lower portion exceeds the specified torque value. If, in one instance, it is desirable to rotate the illustrative packer 200 and other components connected to it, such as to orient a perforating gun, the clutch assembly 440 would allow such rotation.

The illustrative clutch assembly 440 includes a clutch housing 446 that is affixed to the lower portion 444 and extends concentrically over the upper portion 442. The clutch housing 446 and upper portion 442 define a cavity 448 therebetween that receives a spring member 450. The spring member 450 bears on both the upper portion 442 and the clutch housing 446, and causes the lower portion 444 to forcibly bear on the upper portion 442 at mating surface 452. As the J-slot pins 406 engage the angled portion of the intermediate J-slot portion 242, the resulting load disengages the upper portion 442 from the lower portion 444 and allows the residual tubing torque between the upper portion 442 and the lower portion 444 to unwind.

Figure 7A:
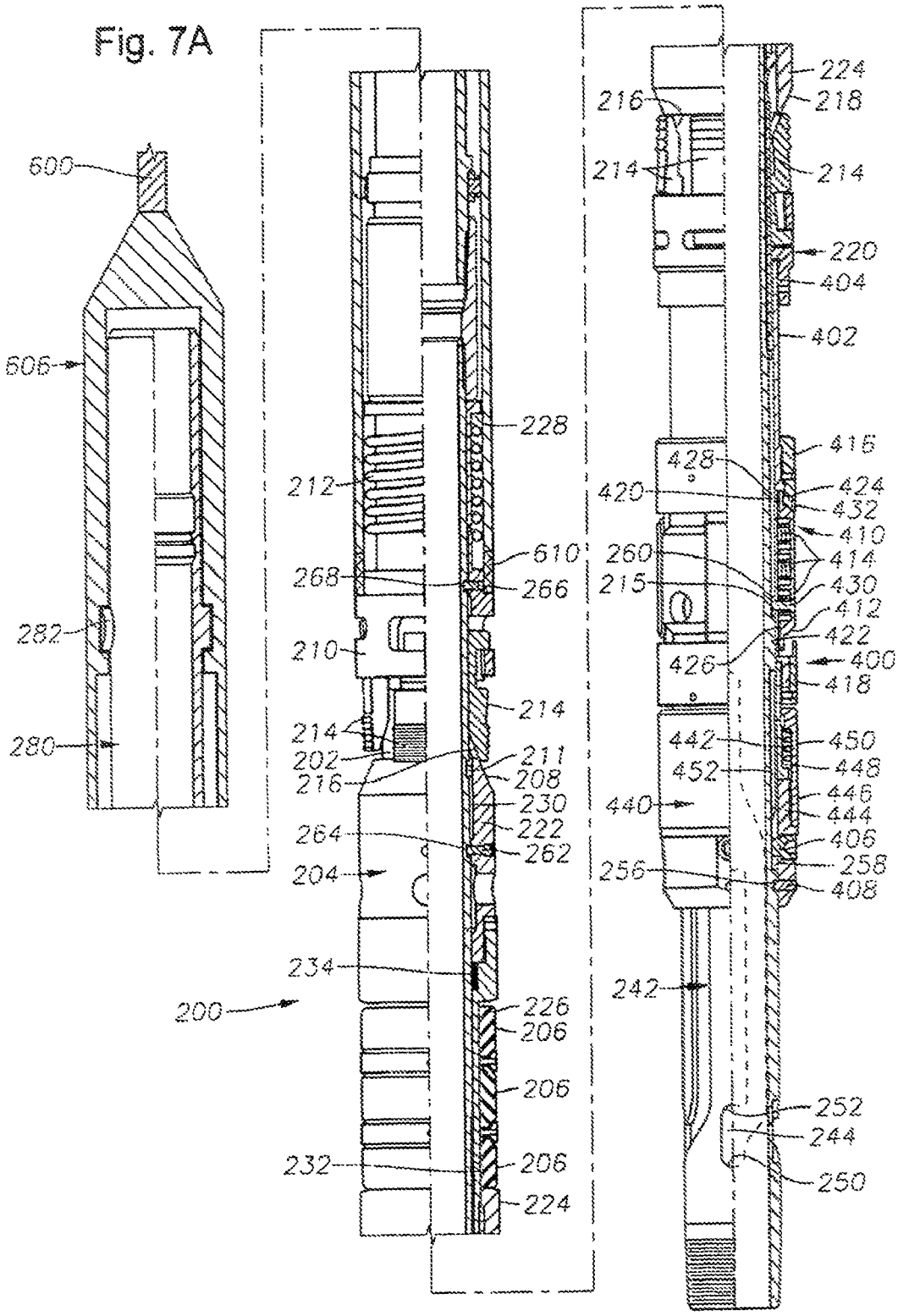
FIGS. 7A-7D are partial cross-sectional views of the illustrative packer of FIG. 2 coupled with the illustrative resetable adapter component of FIGS. 4A and 4B.
Figure 7B:
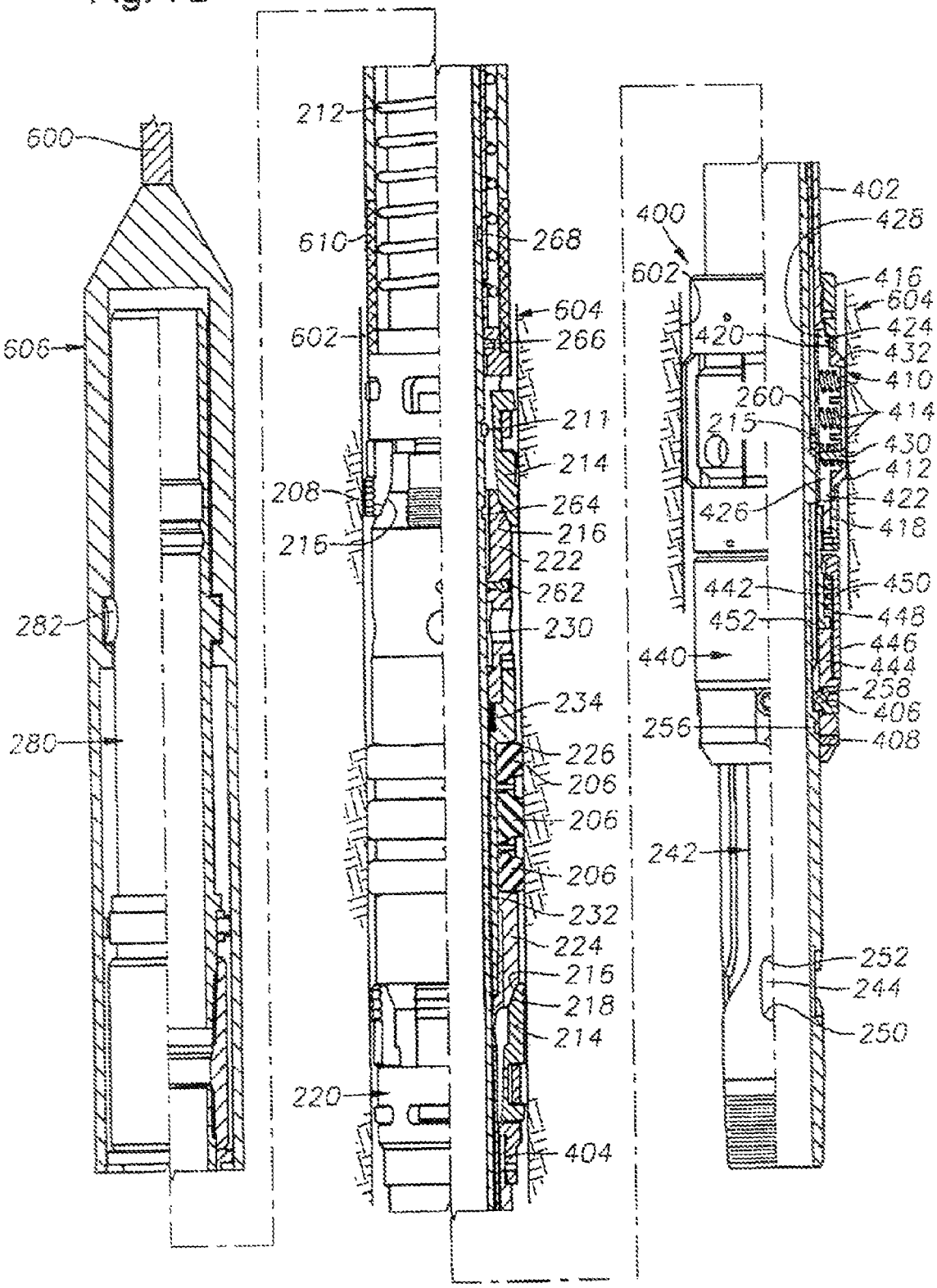
Figure 7C:
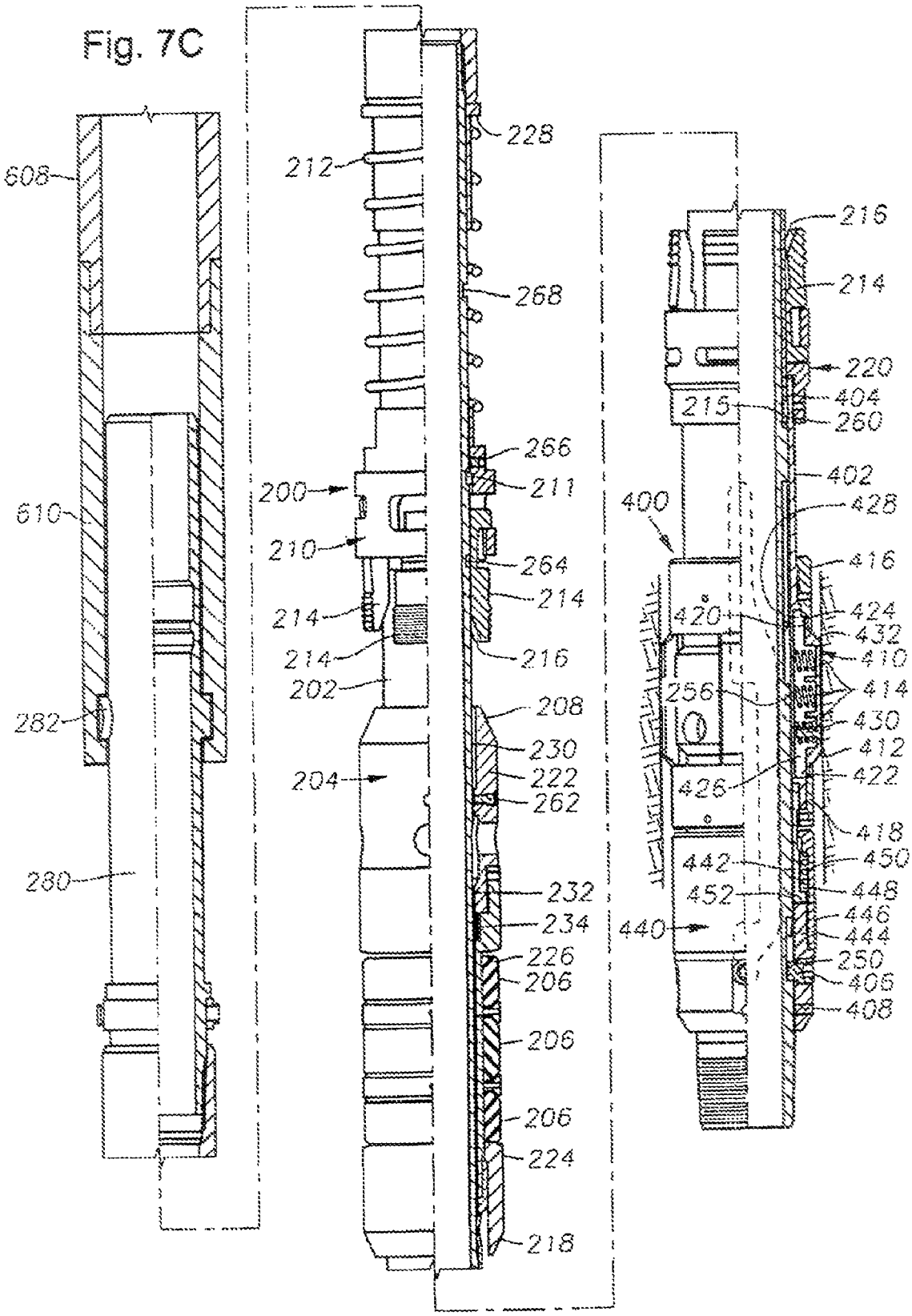
Figure 7D:
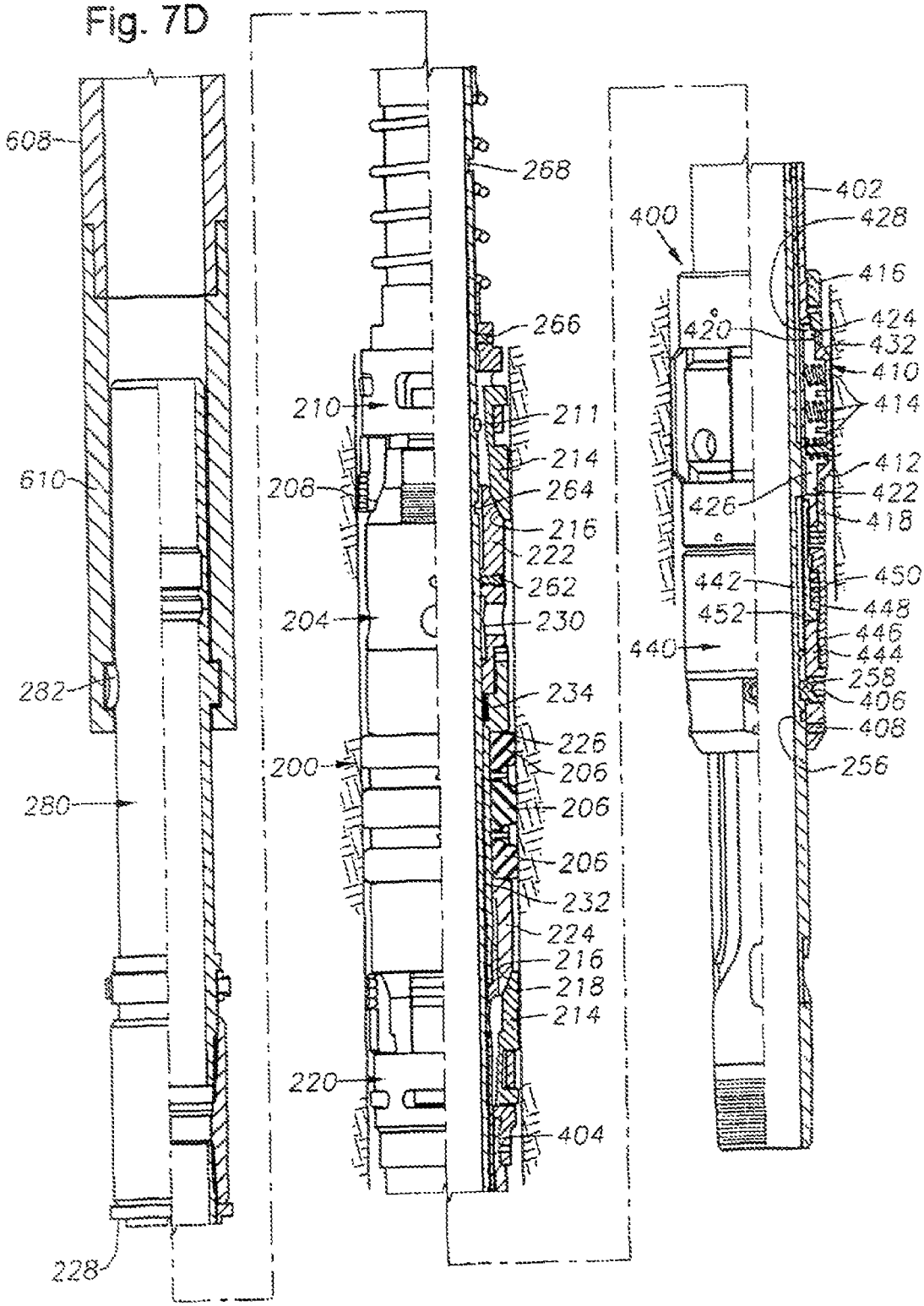

Prior to use, the illustrative resetable adapter component 400 is concentrically received over the component engaging portion 240 of the illustrative packer 200 as shown in FIGS. 7A and 7D. The upper end 404 of the tubular body 402 is coupled to the lower slip assembly 220. FIG. 7A depicts the illustrative packer 200 in the "pre-set" condition, as described above with respect to FIG. 6A, to pass through the well bore without gripping or sealing against the well bore wall, and thereafter be actuated to grip and seal against the well bore wall. The J-slot pins 406 of the resetable adapter component 400 are received in the lower ends 258 of the upper portion 248 of the J-slots 242. The shear screws 408 are received in the detents 256. The internal seal 234 substantially seals with the sealing surface 230 of the central body 202. The illustrative packer 200 is configured in the pre-set condition if the illustrative packer 200 is to be initially deployed and set via wireline. To aid in passage of the illustrative packer 200 into the well bore, the drag blocks 412 can be retained in the radially retracted position as discussed above, so that the drag blocks 412 do not substantially engage the interior of the well bore and hinder ingress through the well bore.

FIG. 7B depicts the illustrative packer 200 coupled with the illustrative resetable adapter component 400 and supending from a wireline 600 in the set condition. As with the configuration depicted in FIG. 6B and discussed above, the wireline actuation tool 606 is coupled to the tool engaging stub 280 of the illustrative packer 200. The wireline actuation tool 606 has been actuated to extend the distance between its end 610 and the location at which it engages lugs 282. Accordingly, the wireline actuation tool 606 has moved the central body 202 axially upward in relation to the upper slip assembly 210, and compressed the upper slip assembly 210, the seal body 204, and the lower slip assembly 220 between the end 610 of the wireline actuation tool 606 and the resetable adapter component 400. The slip members 214 of the upper slip assembly 210 and of the lower slip assembly 220 have been forced outward to grip the interior wall 602 of the well 604. The upper portion 222 and the lower portion 224 of the seal body 204 are axially compressed to compress the packer seals 206 and deform the packer seals 206 to extend radially into sealing engagement with the interior wall 602 of the well 604. As discussed above, the illustrative packer 200 is pressure energized in the set condition.

FIG. 7C depicts the illustrative packer 200 in a "pre-set/unset" condition. The pre-set/unset condition is similar to the unset condition described above with respect to FIG. 6C; however, because the illustrative packer 200 is coupled to the resetable adapter component 400, the illustrative packer 200 can be changed to the set condition downhole. The pre-set/unset condition corresponds to the illustrative packer 200 configured to pass through the well bore without gripping or sealing against the well bore wall, and thereafter be actuated to grip and seal against the well bore wall. In the pre-set/unset condition, the J-slot pins 406 are received in the lower receptacle 250 of the lower portion 244 of the J-slots 242. The internal seal 234 is positioned over the non-sealing surface 232 to allow passage of fluid between the central body 202 and the seal body 204. Additionally, the upper slip assembly 210 rests against stop shoulder 211 and is spaced apart from the seal body 204. The seal body 204 rests against the stop shoulder 215 and is further spaced apart from the lower slip assembly 220. As is discussed in more detail below, in changing from the pre-set/unset condition to the set condition, the central body 202 is rotated and pushed downward relative to the illustrative resetable adapter component 400. When the illustrative packer 200 coupled to the illustrative resetable adapter component 400 is released from the set condition it changes to the pre-set/unset condition. The illustrative packer 200 is configured in the pre-set/unset condition if the illustrative packer 200 is to be initially deployed and set via tubing string.

FIG. 7D depicts the illustrative packer 200 in a set condition supending from a tubing string 608. The tubing string 608, having an on/off tool 610, is coupled to the tool engaging stub 280 to lower the illustrative packer 200 into the well 604. The drag blocks 412 are configured in the radially extended position. While being lowered through the well 604, the drag blocks 412 may drag on the interior wall 602 of the well 604 and impart an upward force on the resetable adapter component 400. The upward force does not, however, dislodge the J-slot pins 406 from the lower portion 244 of the J-slots 242, because the J-slot pins 406 are received in the upper receptacle 252 of the lower portion 244. Once in position, the central body 202 is rotated clockwise via the tubing string 608. The J-slot pins 406 are released from the lower portion 244 of the J-slots 242 and moved into the intermediate portion 246 of the J-slots 242. The central body 202 is moved downward relative to the resetable adapter component 400 by applying a downward force through the tubing string 608, for example by allowing the weight of the tubing string 608 to weigh downward upon the central body 202. The resetable adapter component 400 stays substantially stationary relative to the well 604, because the drag blocks 412 engage the interior wall 602 of the well 604. The downward movement compresses the upper slip assembly 210, seal body 204 and lower slip assembly 220 between the resetable adapter component 400 and the spring member 212 as the J-slot pins 406 traverse the intermediate portion 246 of the J-slots 242 and enter the upper portion 248. Additionally, the central body 202 is shifted downward relative to the seal body 204 so that the internal seal 234 moves from over the non-sealing surface 232 to substantially sealing against the sealing surface 230 of the central body 202. Compressing the upper slip assembly 210, seal body 204 and lower slip assembly 220 between the resetable adapter component 400 and the spring member 212 drives the slip members 214 to grip the interior wall 602 of the well 604 and deforms the packer seals 206 into substantial sealing engagement with the interior wall 602 of the well 604. Thereafter, the illustrative packer 200 is in the set condition, as depicted in FIG. 7D.

The illustrative packer 200 is changed from the set condition to the pre-set/unset condition, as shown in FIG. 7C, in the same manner that it is changed from the pre-set condition to the unset condition discussed above. If the illustrative packer 200 was run on wireline, the change may be performed with the wireline actuation tool 606 (if so configured), or the wireline actuation tool 606 can be configured to release from the tool engaging stub 280 after actuation and a tubing string 608 having an on-off adapter 610 can be attached in its place. The illustrative packer 200 is changed to the pre-set/unset condition by applying a downward force through the central body 202, rotating the central body 202 clockwise to release the J-slot pins 406 from the upper portion 248 of the J-slots 242, and applying an upward force to the central body 202 to move the J-slot pins 406 to the lower portion 244 of the J-slots 242. The central body 202 shifts upward relative to the seal body 204, moves the internal seal 234 over the non-sealing surface 232 to allow passage of fluid between the central body 202 and the seal body 204, and begins equalizing pressure across the illustrative packer 200. Further movement of the central body 202 upward releases the upper slip assembly 210, lower slip assembly 220 and packer seals 206 from engagement with the interior wall 602 of the well 604. If the drag blocks 412 of the resetable adapter component 400 are retained in the radially retracted position, the central body 202 bears against and moves the release ring 260 as it moves, shears the shear screws 430, and releases the drag blocks 412 into the extended position. Thereafter, the illustrative packer 200 is in the pre-set/unset condition and can be withdrawn from the well 604 or returned to the set condition at the same or another location in the well 604.

Operation to set the illustrative packer 200 coupled to the illustrative resetable adapter component 400 is as follows. If desired to set on wireline, the resetable adapter component 400 is fixed to the component engaging portion 240 of the illustrative packer 200 with shear screws 430 with the J-slot pins 406 in the upper portion 248 of the J-slots 242. A wireline actuation tool, such as wireline actuation tool 606, is coupled to the tool engaging stub 280 and the illustrative packer 200 is configured in the pre-set condition as shown in FIG. 7A. Thereafter, the illustrative packer 200 is inserted into the well 604 and lowered to the desired location. Once in position (see FIG. 7B), the wireline actuation tool 606 is actuated to change the illustrative packer 200 from the preset condition to the set condition. In the set condition, the illustrative packer 200 grips and seals against the interior wall 602 of the well 604. The wireline actuation tool 606 may be configured to release from the illustrative packer 200 after changing the illustrative packer 200 from the preset condition to the set condition.

If desired to set on tubing, the resetable adapter component 400 is received on the component engaging portion 240 of the illustrative packer 200 with the J-slot pins 406 in the lower portion 244 of the J-slots 242 as shown in FIG. 7C. A tubing string 608 having an on/off adapter 610 is stabbed over the tool engaging stub 280 to engage the illustrative packer 200. The illustrative packer 200 is configured in a pre-set/unset condition. Thereafter, the illustrative packer 200 is inserted into the well 604 and lowered to the desired location. Torque between the illustrative packer 200 and the resetable adapter component 400, for example resulting from manipulating or moving the system during running in, is relieved at the clutch assembly 440. Once in position (see FIG. 7D), the central body 202 is rotated clockwise via the tubing string 608 and moved downward relative to the resetable adapter component 400 (which is engaging the interior wall 602 of the well 604 with the drag blocks 412) to change the illustrative packer 200 to the set condition. Thereafter, the tubing string 608 can be released from the on/off adapter 610 and withdrawn from the well 604, or may remain attached to the on/off adapter 610. The illustrative packer 200 thus operates to substantially seal and grip the interior wall 602 of the well 604.

In either instance, whether set on wireline or set on tubing, the illustrative packer 200 is changed to the pre-set/unset condition by applying a downward force through the central body 202 (for example via the tubing string 608), rotating the central body 202 clockwise, and then applying an upward force to the central body 202. The illustrative packer 200 may then be withdrawn from the well 604 or may be changed to the set condition at the same location or at another axial location within the well 604.

Of note, if prior to changing the illustrative packer 200 to the pre-set/unset condition, it is desirable to rotably position other tools coupled to the central body 202 (e.g. a tubing conveyed perforating gun), a downward force is applied through the central body 202 to lift the J-slot pins 406 slightly out of the lower ends 258 of the upper portion 248 of the J-slots 242 and the central body 202 is rotated until the J-slot pins 406 reside in and abut the upper end of the intermediate portion 246 of the J-slots 242. Further downward force applied to the central body 202 disengages the clutch assembly 440, thus allowing the central body 202 and any other tools coupled to the central body 202 (e.g. a tubing conveyed perforating gun) to rotate free of the slip assemblies 210, 220 and seal body 204. The central body 202 and coupled tools are rotated as desired (in an instance of the perforating gun, to orient the perforating gun as desired). The slip assemblies 210, 220 and seal body 204 remain engaged to the wall 602 of the well bore 604. Thereafter, J-slot pins 406 are returned to the lower ends 258 of the upper portion of the J-slots 242 and the downward force is released.

If desired to change the illustrative packer 200 back to the set condition (FIG. 7D), the illustrative packer 200 is moved to the desired position or maintained in the same position in the well 604, and the central body 202 is rotated clockwise via the tubing string 608 and moved downward relative to the resetable adapter component 400. The illustrative packer 200 can be changed between the set condition and the pre-set/unset condition as many times as is desired to set and release the illustrative packer 200 from various locations within the well 604. When operations are complete, the illustrative packer 200 may be withdrawn from the well 604.

Yet another illustrative resetable adapter component 500 is depicted in FIG. 5. Like the illustrative resetable adapter component 400 shown in FIGS. 4A and 4B, the illustrative resetable adapter component 500 enables the illustrative packer 200 to be set on wireline or set by tubing, released by tubing, and reset at the same or a different location in the well bore by tubing without withdrawing the illustrative packer 200 from the well bore. The illustrative resetable adapter component 500, however, differs from the illustrative resetable adapter component 400 in that the clutch assembly 440 is omitted. The operation of the illustrative resetable adapter component 500 is substantially the same as that of illustrative resetable adapter component 400.

Additional wireline and resettable adapter components can be provided that incorporate different or additional features. For example, in certain embodiments, the adapter components can include or further include one or more of sensors that tell the state (set/unset/other) of the modular well tool 12 (e.g. illustrative packer 200), temperature sensors, pressure sensors, compositional sensors to measure the composition of the downhole fluids, provisions for fiber optic communications, provisions for laser induced breakdown spectroscopy, downhole computer processors, downhole electronic data storage, valves, a tubing conveyed perforating gun, sand filtration screens, and other features. In certain embodiments, pressure sensors can be provided on the adapter component to sense leakage past seals (e.g. seals 206 of the illustrative packer 200).

Of note, the illustrative packer 200 has been described above used singly within the well 604. However, in some instances it is desirable to set more than one packer in the well 604 at the same time. For example, a first illustrative packer 200 may be set in the well 604 and the wireline service tool 606 or tubing string 608 released from the first illustrative packer 200. Thereafter, a second illustrative packer 200 may be set in the well 604 above the first illustrative packer 200. If additional packers are desired to be set in the well 604, the wireline service tool 606 or tubing string 608 is released from the second illustrative packer 200 and a third and subsequent illustrative packers 200 are set above the second illustrative packer 200 in the same manner. Multiple illustrative packers 200 are released from the well 604 sequentially starting at the upper most illustrative packer 200 and working to the lowermost illustrative packer 200. The tubing string 608 is attached to the upper most packer 200, the upper most packer 200 is released from the well 604, and the upper most packer 200 is withdrawn from the well 604, the tubing string 608 is attached to the next packer 200, the next packer 200 is released from the well and withdrawn to the surface, and so on.

Also of note, although the discussion above concentrates on the illustrative packer 200 installed in the well 604 and does not address additional devices that may be coupled to the illustrative packer 200, in many instances additional devices, such as valves, perforating guns, slotted pipe, sand control screens, and other completion and/or intervention devices, will be coupled to the lower end of the illustrative packer 200 to perform operations within the well bore 604.

Figure 8:
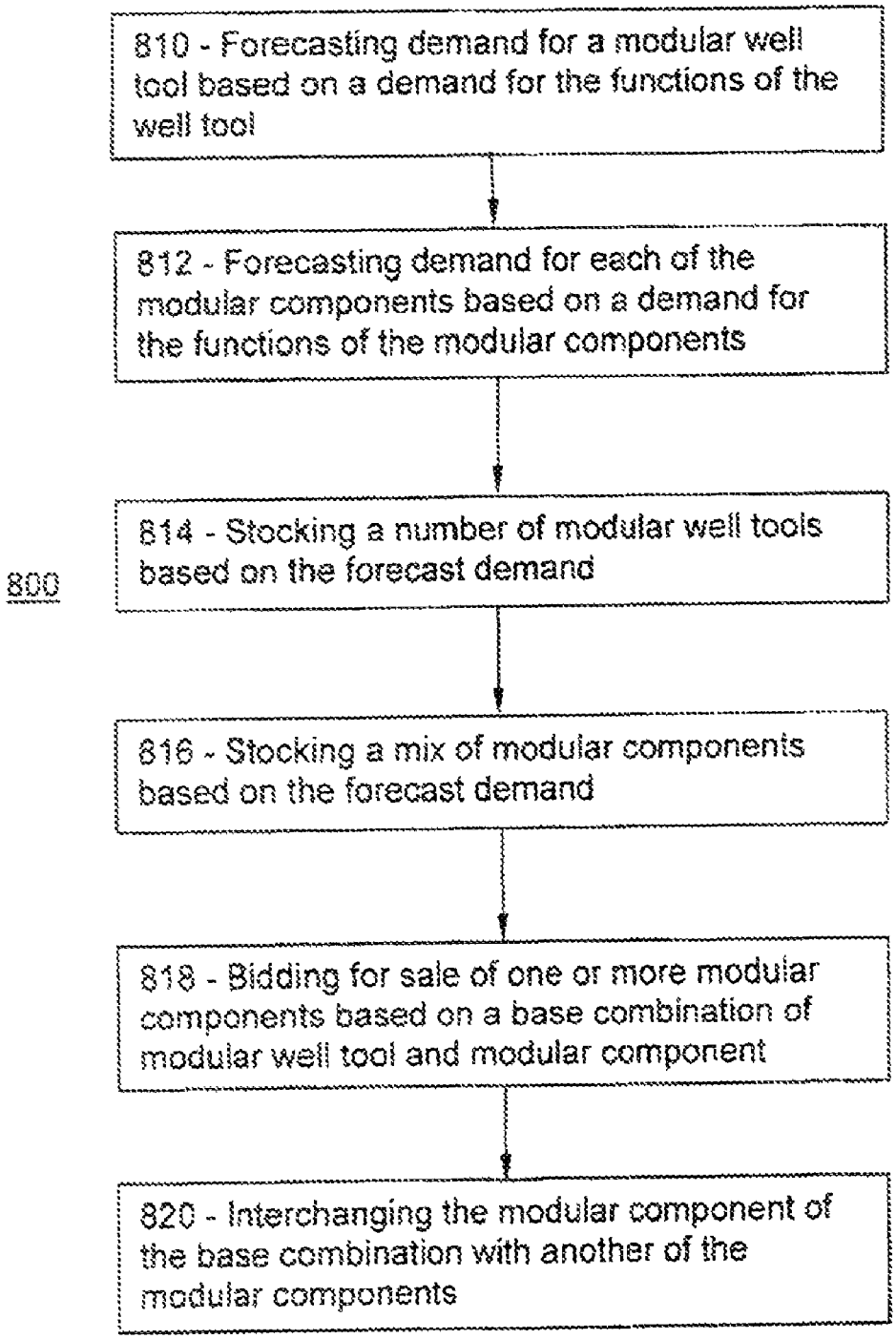
FIG. 8 is a flow chart of an illustrative method in accordance with the invention.

Use of a modular well tool, for example illustrative packer 200, enables an illustrative method 800 schematically depicted in FIG. 8. Operations 810 and 812 of the illustrative method 800 address forecasting demand for the modular well tool and the modular components. At operation 810 the demand for a modular well tool is forecast based on a forecast and/or historical demand for a plurality (in some instances all) of the functions that the modular well tool can be configured to perform. By way of example using the illustrative packer 200, the demand for the illustrative packer 200 can be forecast based on a historical and/or forecast demand for packers whether modular or not and including packers that can be set on wireline, set on tubing, and that can be reset. In other words, the illustrative packer 200 can satisfy the demand for multiple different configurations of packers, so the demand for the illustrative packer 200 can be forecast based on the sum of all the different configurations.

At operation 812 the demand for each modular component is forecast based on a forecast and/or historical demand for the specific functions of the respective modular components. In the instance of the illustrative packer 200, the forecast demand for the illustrative wireline adapter component 300 is determined based on a forecast and/or historical demand for packers (modular or not) that are able to be set on wireline, but not reset. The demand for the illustrative resetable adapter component 400 and illustrative resetable adapter component 500 are determined based on a forecast and/or historical demand for packers (modular or not) that are able to be reset. The demand is allocated between the illustrative resetable adapter component 400 that includes the clutch assembly 440 and the illustrative resetable adapter component 500 that omits the clutch assembly 440.

At operation 814, a number of modular well tools is stocked (received) based on the forecast demand. At operation 816 a mix (i.e. number of each) of the modular components is stocked (received) based on the forecast demand. The modular well tools and/or the modular components can be received from another entity that is associated with the same company as the entity receiving the modular component (e.g. from a central manufacturing plant of the company) or from a third party (e.g. a third party manufacturer). In one instance, a field location can stock the modular well tools and a mix of modular components that matches the demand in its sales area. Each of the modular well tools stocked need not be identical. In some instances, components such as the seals, slips, and other sub components may be interchangeable with other configurations of seals, slips, and sub components to allow a degree of flexibility in the modular well tool. For example, one of multiple possible seals may be selected for incorporation into a particular well tool based on the expected temperature and pressure the tool must operate under.

Because a single configuration of modular well tool satisfies the demand for a plurality of functions, the modular well tools can be manufactured in comparatively large numbers relative to each of the different specialized conventional well tools that would otherwise be needed to meet the varied demands. Accordingly, manufacture of the modular well tool can benefit from economies of scale not achievable with specialized well tools. Additionally, inventory is reduced, because one modular well tool can be configured using the modular components to meet demand for multiple different specific configurations of well tools.

Operations 818 and 820 of the illustrative method 800 address the flexibility of configurations available with the modular well tool. At operation 818, a seller of modular well tools and modular components bids for a contract to supply one or more well tools of a general type (or services using a well tool of a general type) with one or more base combinations of modular well tools and modular components. In some instances, the base combination is selected based on price. In one instance, the base combination is selected to be the least expensive combination of modular well tool and modular component. For example, the seller may select the base combination to be the illustrative packer 200 and wireline adapter component 300, because the wireline adapter component 300 is less expensive to manufacture than either of the resettable adapter components 400 and 500. Therefore, when responding to a request for bid that includes a request for one or more packers, without specifying the desired features of the packers, the seller's bid can be based on one or more base combinations. If the base combination is selected by the seller because of its low price, then the bid price will be low.

If the request for bid specifies desired features of the well tool, the seller can provide the appropriate modular well tool and modular component combination (and in some instances, the least expensive combination) to meet the desired features. For example, if the request for bid specifies that some number of the packers are to be resettable, the bid can include one or more combinations of the illustrative packer 200 and the resetable adapter component 400. Selectively combining modular components based on the features allows the modular well tool to be customized to the specific needs of the application. Typically, the more features that are incorporated into a well tool, the more the well tool will cost. Customizing the modular well tool as described herein enables the expense associated with supplying a fully featured well tool or a well tool with features that are not desired to be reduced, because only those features that are desired are supplied or if additional features are supplied, fewer additional features are provided.

At operation 820, if the base combination of modular well tool and modular component have been supplied, for example as per the bid, and it is later determined that additional features are desired or necessary for a particular application, the modular component of the base combination can be interchanged for another modular component having the desired features. For example, the modular well tool can be supplied to or received at the well site with the modular component of the base combination (made up or apart from one another), as well as one or more additional modular components. If prior to running the base combination into the well, or after the base combination has been run into the well and withdrawn to the surface, it is determined that one or more additional features not supplied by the base combination are desired, the modular component corresponding to the additional desired features can be coupled to the modular well tool. In the instance of a base combination of the illustrative packer 200 and the illustrative wireline adapter component 300, the illustrative packer 200 and the illustrative wireline adapter component 300 (made up or apart from one another) can be supplied to or received at the well site together with one or more of the illustrative resetable adapter components 400 and 500. If it is determined that it is desirable to set and reset the illustrative packer 200 in the well 604, the illustrative packer 200 can be coupled to one of the illustrative resetable adapter components 400 or 500 instead of (or replacing) the illustrative wireline adapter component 300.

While the operations of illustrative method 800 are depicted in FIG. 8 in a specified order, the operations may be performed in any order or out of order. Additionally, one or more of the operations may be omitted and/or other operations may be included.

A number of embodiments of the invention have been described. Nevertheless, it will be understood that various modifications may be made without departing from the spirit and scope of the invention. For example, in one instance the central body can be provided with a blind end or intermediate portion and operate as a bridge plug. In another instance, the illustrative packer can be coupled to a tubing or liner to operate as a tubing hanger. Accordingly, other embodiments are within the scope of the following claims.

What is claimed is:

1. A well tool system, comprising:

a well tool configured for insertion into a well, the well tool comprising:

a portion configured to couple to at least one of a wireline service tool or a tubing string; and an adapter component engaging portion configured to couple and uncouple to an adapter component and thereby couple and uncouple the adapter component to the wireline service tool or the tubing string, the well tool configured to perform an operation distinct from coupling and uncoupling the adapter component to the wireline service tool or the tubing string; and at least a first and a second interchangeable adapter component, each adapter component configured to couple to the adapter component engaging portion, each adapter component configured to perform corresponding, distinct functions during the well tool operation, the well tool operation performed in a first manner when the first adapter component is coupled to the wireline service tool or the tubing string and the well tool operation performed in a second different manner when the second adapter component is coupled to the wireline service tool or the tubing string.

2. The well tool system of claim 1, wherein the portion configured to couple to at least one of the wireline service tool or the tubing string is proximate a first end of the well tool and the adapter component engaging portion is proximate a second end of the well tool opposite the first end.

3. The well tool system of claim 1 wherein the first adapter component is configured to enable the well tool to be changed to a set state configured to engage an interior of a well with a wireline service tool and the second adapter component is configured to enable the well tool to be changed to the set state with a tubing string.

4. The well tool system of claim 1 wherein the second adapter component is configured to enable the well tool to be changed from a set state configured to engage an interior of a well to the unset state and back to the set state without removing the well tool from the well.

5. The well tool system of claim 4 wherein the first adapter component is configured to enable the well tool to be changed from the set state to the unset state and cannot be returned to the set state without removing the well tool at least partially from the well.

6. The well tool system of claim 1 further comprising a third interchangeable adapter component configured to couple to the adapter component engaging portion and enable a portion of the well tool that engages the interior of the well to rotate about a longitudinal axis of the well tool relative to a portion of the well tool that does not engage the interior of the well.

7. The well tool system of claim 1 wherein the well tool is changed between a set state configured to engage an interior of a well and an unset state by manipulating at least a portion of the well tool relative to the coupled adapter component;

wherein the first adapter component is configured to be coupled to the well to enable manipulation of the well tool relative to the first adapter component when the well tool is in the set state and released from the well to move with the well tool when the well tool is in the unset state; and wherein the second adapter component is configured to be coupled to the well to enable manipulation of the well tool relative to the second adapter component when the well tool is in both the set and the unset states.

8. The well tool system of claim 1 wherein the well tool is configured to substantially seal against passage of fluids between the well tool and a wall of a well in the set state and allow passage of fluids between the well tool and the wall of the well in the unset state.

9. The well tool system of claim 8 wherein the well tool further comprises:

a central body; and one or more seals carried on the central body between the ends, the seals configured to substantially seal with the wall of the well in the set state, the well tool configured to change between the set state and the unset state by manipulating at least the central body relative to the coupled adapter component, wherein the first adapter component is configured to be coupled to the well to enable manipulation of the central body relative to the first adapter component when the well tool is in the set state and released from the well to move with the central body when the well tool in the unset state, and the second adapter component is configured to be coupled to the well to enable manipulation of the well tool relative to the second adapter component when the well tool is in both the set and the unset states.

10. The well tool system of claim 9 wherein the second adapter component is configured to be coupled to the well with radially compliant members configured to grip the wall of the well.

11. The well tool system of claim 10 wherein the first and second adapter components are configured to be coupled to the well in the set state at least in part by being coupled to the seals engaging with the wall of the well.

12. A method, comprising:

coupling a wireline service tool or a tubing string to a portion of a well tool;

coupling a first interchangeable adapter component to an adapter engaging portion of the well tool;

performing a well tool operation in a first manner with the first adapter component coupled to the well tool;

coupling a second interchangeable adapter component to the adapter engaging portion of the well tool, the first and second adapter components configured to perform corresponding, distinct functions during the well tool operation; and performing the well tool operation in a second, different manner with the second adapter component coupled to the well tool.

13. The method of claim 12, wherein coupling a wireline service tool or a tubing string to a portion of a well tool comprises coupling a wireline service tool or a tubing string to a portion proximate a first end of a well tool, and coupling the first interchangeable adapter component to an adapter engaging portion of the well tool comprises coupling the first interchangeable adapter component to an adapter engaging portion at a second end of the well tool opposed to the first end.

14. The method of claim 12 further comprising:

performing a first function during performance of the well tool operation in the first manner; and performing a second function during performance of the well tool operation in the first manner.

15. The method of claim 14 further comprising:

performing a third function during performance of the well tool operation in the second manner; and performing a fourth function during performance of the well tool operation in the second manner.

16. The method of claim 15 wherein the first function comprises setting the well tool with a wireline service tool and the third function comprises setting the well tool with a tubing string.

17. The method of claim 14 wherein the second function comprises setting the well tool, unsetting the well tool, and re-setting the well tool without removing the well tool from the well bore.

18. The method of claim 14 wherein the second function comprises allowing relative rotation between a portion of the well tool that engages a wall of the well and a portion of the well tool that does not substantially engage the wall of the well.

19. The method of claim 12 further comprising transporting both the first and the second adapter components to the well prior to coupling one of the adapter components to the well tool.

20. The method of claim 12 further comprising coupling one of the first or the second interchangeable adapter components to the adapter engaging portion of the well tool prior to transporting the well tool to the well.

21. The method of claim 12, further comprising:

withdrawing the well tool from the well after performing the well tool operation in the second manner;

uncoupling the second adapter component from the well tool; and coupling a third interchangeable adapter component to the adapter engaging portion of the well tool.

* * * * *